US011067366B2

(12) United States Patent
Nielsen et al.

(10) Patent No.: US 11,067,366 B2
(45) Date of Patent: Jul. 20, 2021

(54) LEVELING JACK FOR A GUN SIGHT OF A RIFLE

(71) Applicants: Kristian Nielsen, Chciago, IL (US); James Wener, Chicago, IL (US)

(72) Inventors: Kristian Nielsen, Chciago, IL (US); James Wener, Chicago, IL (US)

(73) Assignee: FIX IT STICKS, Chicago, IL (US)

( * ) Notice: Subject to any disclaimer, the term of this patent is extended or adjusted under 35 U.S.C. 154(b) by 0 days.

(21) Appl. No.: 16/896,642

(22) Filed: Jun. 9, 2020

(65) Prior Publication Data

US 2021/0010781 A1 Jan. 14, 2021

Related U.S. Application Data

(60) Provisional application No. 62/871,962, filed on Jul. 9, 2019.

(51) Int. Cl.
*F41G 1/54* (2006.01)
*F41G 1/38* (2006.01)

(52) U.S. Cl.
CPC ..... *F41G 1/545* (2013.01); *F41G 1/38* (2013.01)

(58) Field of Classification Search
CPC ..... F41G 1/545; F41G 1/38
USPC ..... 42/138
See application file for complete search history.

(56) References Cited

U.S. PATENT DOCUMENTS

RE14,009 E * 11/1915 Warner ..... F41G 1/28 42/136
1,206,060 A * 11/1916 Warner ..... F41G 1/28 42/136
2,155,391 A * 4/1939 Arden ..... F41G 1/28 42/125
5,085,200 A * 2/1992 Horton-Corcoran ..... F41B 5/1469 124/25
5,598,829 A * 2/1997 Bednar ..... F41A 17/28 124/25
5,649,520 A * 7/1997 Bednar ..... F41B 5/12 124/25
6,802,304 B1 * 10/2004 Chang ..... F41B 5/1469 124/25
7,588,022 B2 * 9/2009 Chang ..... F41B 5/123 124/25
8,151,509 B2 * 4/2012 Rozitis ..... F41G 11/003 42/125
8,156,678 B2 * 4/2012 Hoel ..... F41G 11/003 42/90
8,240,075 B1 * 8/2012 Mullin ..... F41G 1/38 42/125
9,823,045 B2 * 11/2017 Chu ..... F41B 5/12
10,066,903 B2 * 9/2018 Crispin ..... F41G 1/545

(Continued)

*Primary Examiner* — Samir Abdosh
(74) *Attorney, Agent, or Firm* — Justin Lampel

(57) ABSTRACT

A leveling jack for a gun sight (or 'scope') of a gun or rifle is provided. The leveling jack is movable between at least a first and a second position and is secured to a gun or rifle. The leveling jack has a bottom edge which may be secured to, for example, the picatinny rail of the top of the gun or rifle and an extended bar which contacts and levels the gun sight. The leveling jack may also be secured directly to the gun or rifle without utilizing a picatinny rail. The leveling jack is especially suitable for leveling the gun sight of the gun or rifle in a quick and efficient manner.

11 Claims, 5 Drawing Sheets

(56) References Cited

U.S. PATENT DOCUMENTS

| | | | | |
|---|---|---|---|---|
| 2006/0010759 | A1* | 1/2006 | Penney | F41G 11/001 42/126 |
| 2008/0060629 | A1* | 3/2008 | Chang | F41B 5/1469 124/25 |
| 2015/0131269 | A1* | 5/2015 | Franklin | F41G 1/35 362/110 |
| 2018/0073839 | A1* | 3/2018 | Crispin | F41G 1/48 |
| 2019/0017784 | A1* | 1/2019 | Smith | F41G 1/16 |
| 2021/0010781 | A1* | 1/2021 | Nielsen | F41G 1/545 |

* cited by examiner

LEVELING JACK FOR A GUN SIGHT OF A RIFLE

CROSS REFERENCE TO RELATED APPLICATIONS

The following application is a based on and claims the priority benefit of U.S. provisional application Ser. No. 62/871,962 filed on Jul. 9, 2019; the entire content of which is incorporated by reference.

BACKGROUND OF THE INVENTION

A leveling jack for a gun sight (or 'scope') of a gun or rifle is provided. The leveling jack is movable between at least a first and a second position and is secured to a gun or rifle. The leveling jack has a bottom edge which may be secured to, for example, the picatinny rail of the top of the gun or rifle and an extended bar which contacts and levels the gun sight. The leveling jack may also be secured directly to the gun or rifle without utilizing a picatinny rail. The leveling jack is especially suitable for leveling the gun sight of the gun or rifle in a quick and efficient manner.

Novel gun sights and attachments have been made over the years. For example, U.S. Pat. No. 8,978,287 to Riley discloses a shotgun sight for mounting to the end of a shotgun barrel having a clear plate having a pin extending generally normally from the plate back toward the eye of the shooter and parallel to the axis of the barrel. The plate has a circle surrounding the base of the pin to facilitate proper eye positioning for use of the plate as a sighting device and a dot marked on the plate between the pin and the barrel to serve as an elevation mark. Arcs marked on the plate centered on the pin serve as lead indicators for moving targets.

Further, U.S. Pat. No. 6,321,479 to Sheehan discloses a sighting device having an aperture with a series of visual reference points framing the aperture that are used in concert with a vertical front sight to quickly acquire and precisely aim a firearm at a target. The visual reference points framing the aperture are readily discernable to a shooter, even though the reference points and the aperture may be visually out of focus as the shooter concentrates on the target. The visual reference points framing the aperture are in the form of edges, angles, and vertices that take advantage of the human eye's natural acuity for angular geometric shapes as the shooter visually coordinates the position of the present invention with the vertical front sight and a target. The unobstructed field of view provided by the aperture portion of the present invention combined with readily discernable geometrically shaped visual reference points framing the aperture assist the shooter in precisely aiming a firearm, or other projectile propulsion device, at a target. In addition, rapid and accurate adjustments, or refinements, in the shooter's aim at a target are readily effected with the present invention.

Still further, U.S. Pat. No. 5,067,244 to Montalvo discloses gun sight which is attached to the rear end of the gun barrel near the eye of the shooter including a semi-circular ring through which the shooter can observe a flying target. Two horizontal arms are attached to the sight for alignment parallel to the earth and with a target traveling through the air. Still further, U.S. Pat. No. 2,056,469 to King discloses a sight for a gun having multiple target sights.

However, these patents fail to describe a leveling jack for a gun sight. Further, these patents fail to provide for a leveling jack for a gun sight which is easy to use in a simple and safe manner.

SUMMARY OF THE INVENTION

A leveling jack for a gun sight (or 'scope') of a gun or rifle is provided. The leveling jack is movable between at least a first and a second position and is secured to a gun or rifle. The leveling jack has a bottom edge which may be secured to, for example, the picatinny rail of the top of the gun or rifle and an extended bar which contacts and levels the gun sight. The leveling jack may also be secured directly to the gun or rifle without utilizing a picatinny rail. The leveling jack is especially suitable for leveling the gun sight of the gun or rifle in a quick and efficient manner.

An advantage of the present leveling jack for a gun sight of a gun or rifle is that the present leveling jack is easy to use.

Still another advantage of the present leveling jack for a gun sight for a gun or rifle is that the present leveling jack is easy to install.

And, an advantage of the present leveling jack for a gun sight for a gun or rifle is that the present device may be used to level the scope relative to the rifle, regardless of the scopes orientation. This is an advantage over bubble level products which require you to first visually orient the rifle in a level position, then visually level the scope.

For a more complete understanding of the above listed features and advantages of the leveling jack for a gun sight reference should be made to the detailed description and the drawings. Further, additional features and advantages of the invention are described in, and will be apparent from, the detailed description of the preferred embodiments.

DETAILED DESCRIPTION OF THE PREFERRED EMBODIMENTS

A leveling jack for a gun sight (or 'scope') of a gun or rifle is provided. The leveling jack is movable between at least a first and a second position and is secured to a gun or rifle.

The leveling jack has a bottom edge which may be secured to, for example, the picatinny rail of the top of the gun or rifle and an extended bar which contacts and levels the gun sight. The leveling jack may also be secured directly to the gun or rifle without utilizing a picatinny rail. The leveling jack is especially suitable for leveling the gun sight of the gun or rifle in a quick and efficient manner.

Figure 1:
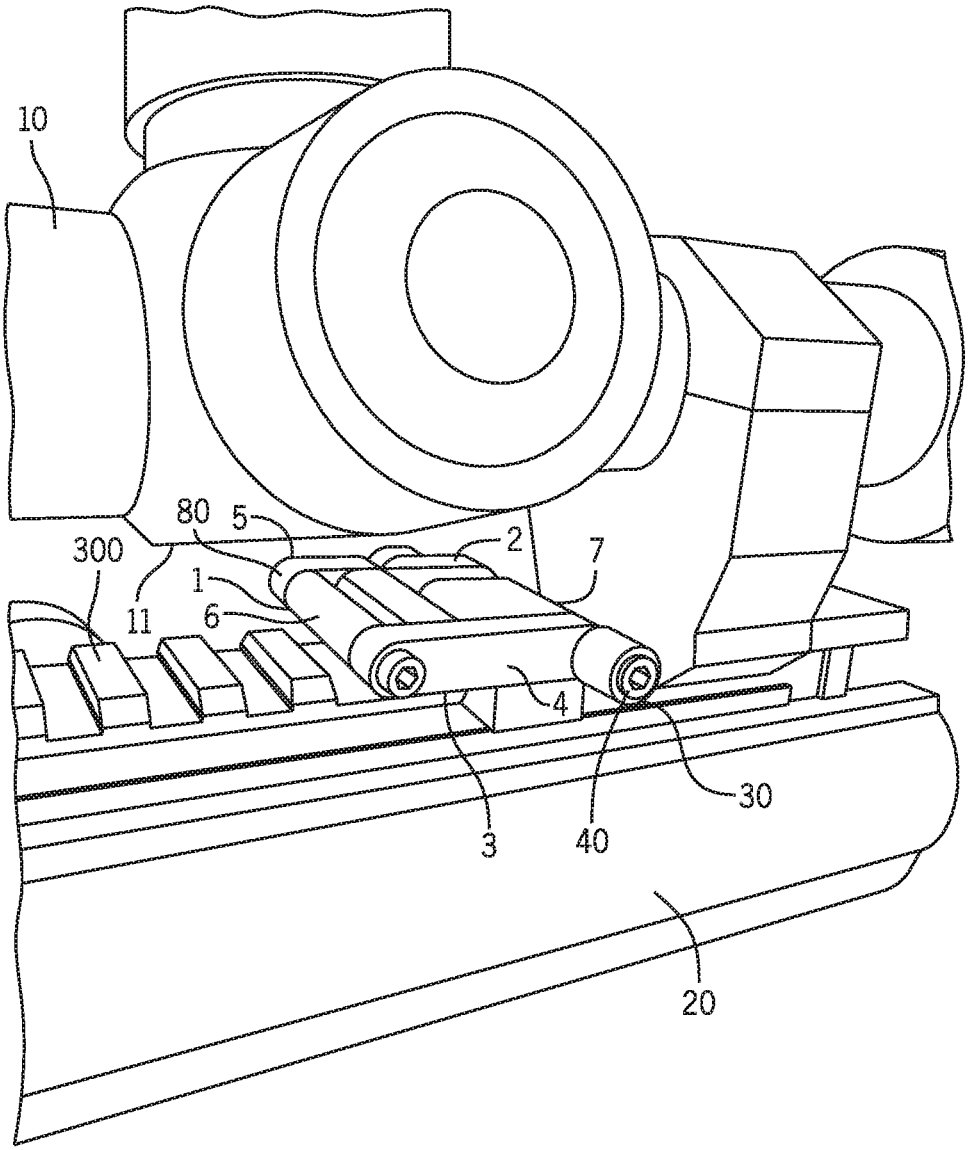
FIG. 1 illustrates a perspective view of the leveling jack for a gun sight secured to the picantinny rail of a gun or rifle wherein the leveling jack is in the first (lowered) position and the gun sight is not yet currently level.
Figure 4:
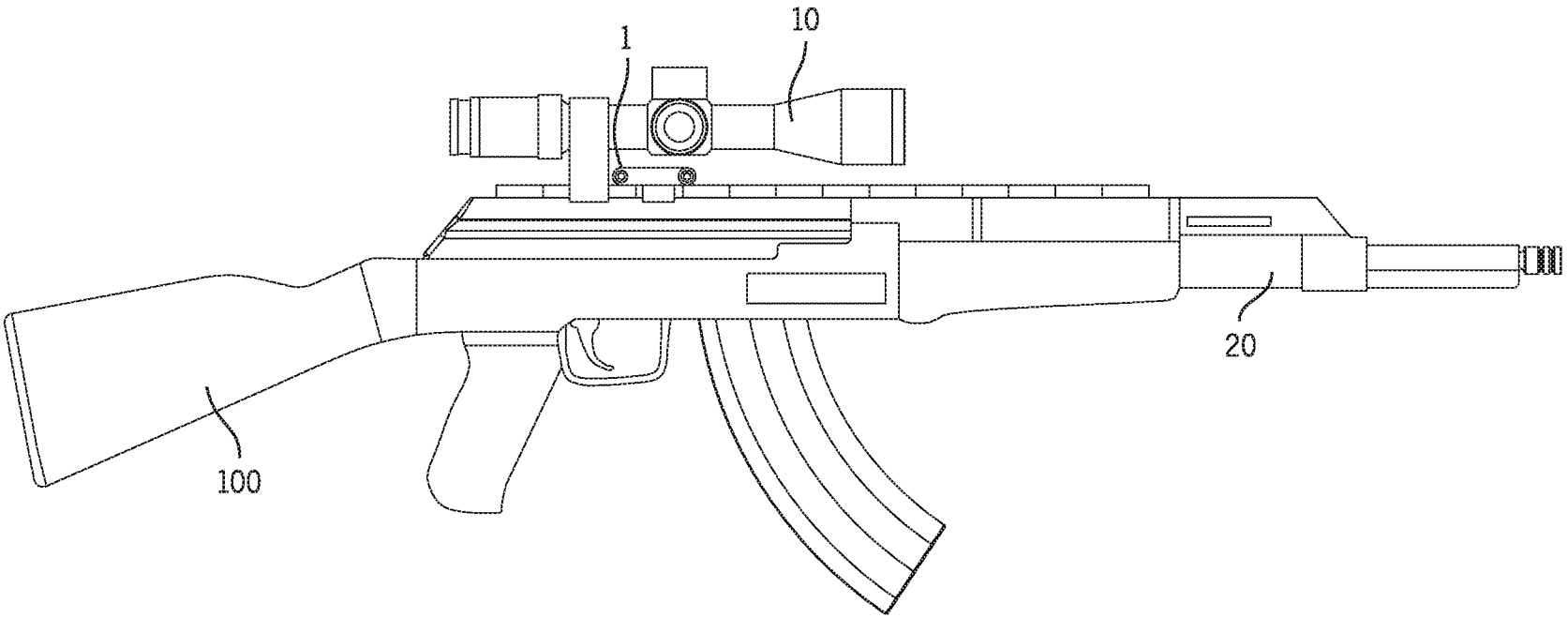
FIG. 4 illustrates a side view of the leveling jack secured to a rifle.
Figure 6:
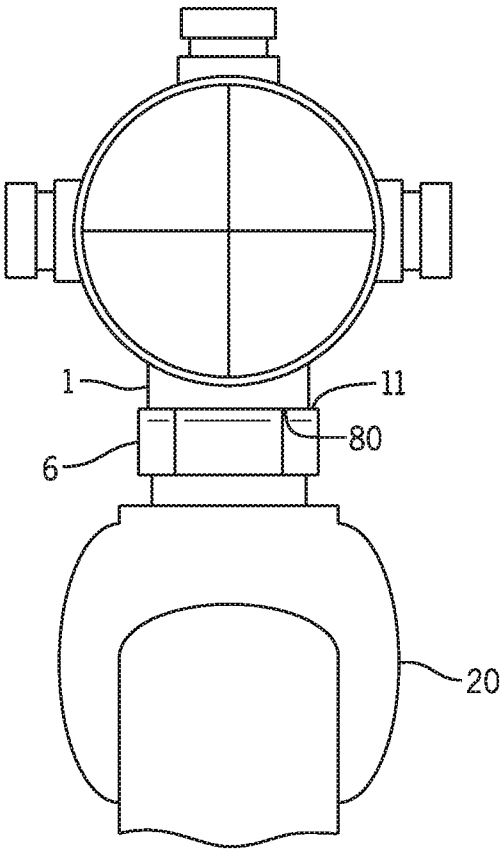
FIG. 6 illustrates a front head-on view of the leveling jack secured to a gun or rifle wherein the gun sight is level as a result of the extended bar of the leveling jack being forced upward to contact with and level the bottom of the gun sight (the second position).
Figure 5:
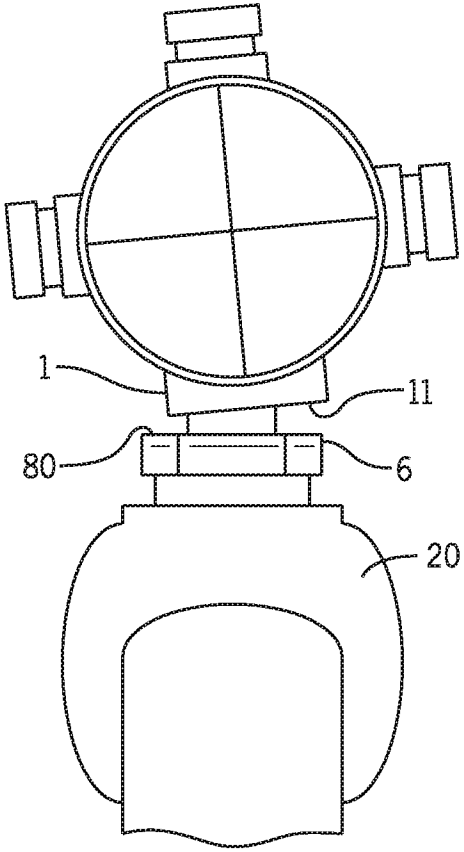
FIG. 5 illustrates a front head-on view of the leveling jack secured to a gun or rifle wherein the gun sight is not yet level and wherein the leveling jack is in the first (lowered) position.

Referring first to FIG. 1, in an embodiment a leveling jack 1 for a gun sight 10 is provided. The leveling jack 1 may have a top 2, a bottom 3, a first side 4, a second side 5 a front 6 and a back 7. The bottom 3 of the leveling jack 1 may be secured to a gun or rifle 100 (FIG. 4). In one embodiment, the device 1 is secured to a barrel 20 of a gun or rifle 100 (FIG. 4). The front 6/top 2 of the leveling jack 1 may contact and level a bottom 11 of the gun sight 10 as described below.

In an embodiment, the first side 4 and/or second side 5 of the leveling jack 1 may have an extended knob 30. The extended knob 30 may take on various embodiments, including a short knob (FIG. 1) or a handle (FIG. 2), both of which operate in the same manner. The extended knob 30 may allow a user to control the leveling jack 1 so as to position and level the gun sight 10 in the proper alignment. The extended knob 30 may be, for example, generally cylindrical (and may have a rough edge for better griping and turning). Passing through the extended knob 30 may be a pivot pin 40. The extended knob 30 and the pivot pin 40 may be located at the back 7 of the leveling jack 1 and may allow the front 6 of the leveling jack 1 to rotate upward and downward with respect to the back 7 of the leveling jack 1 which remains stationary.

Figure 2:
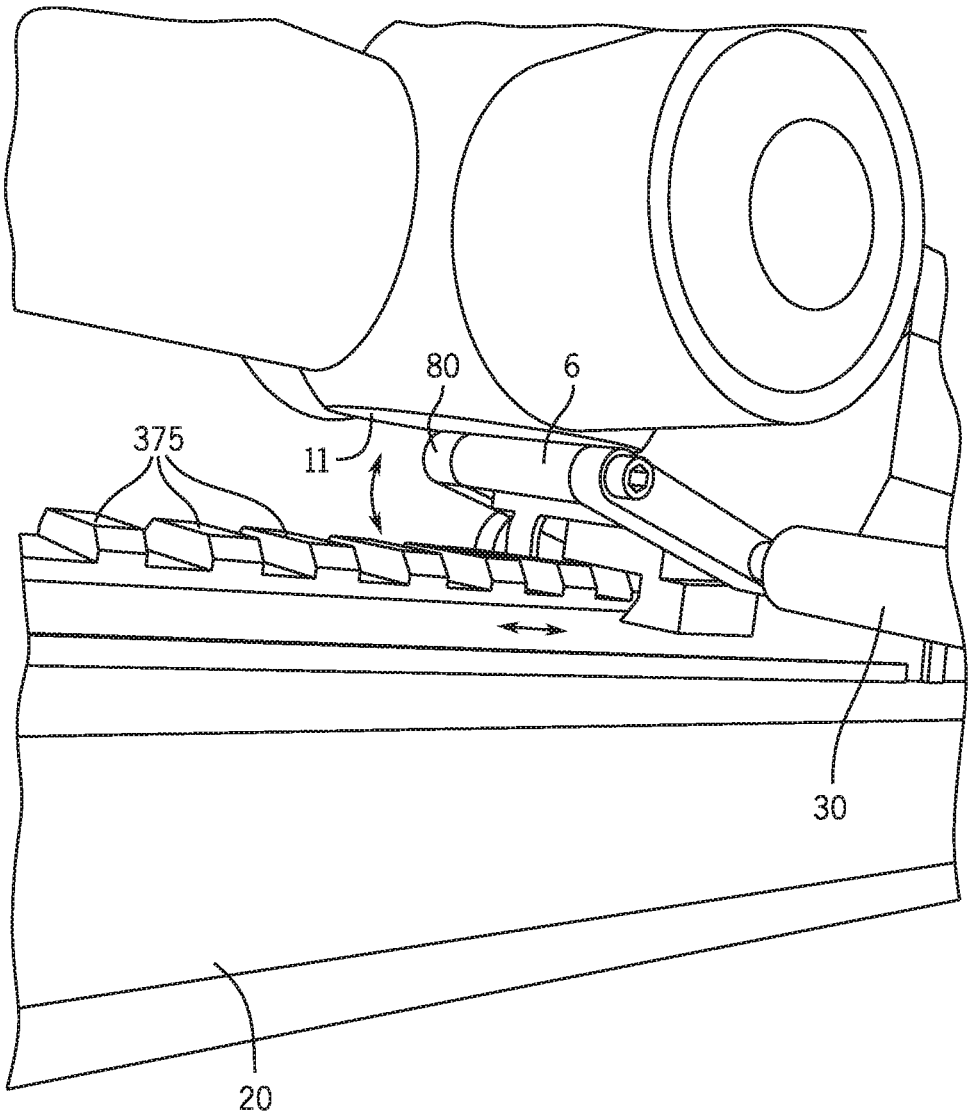
FIG. 2 illustrates a perspective view of the leveling jack for a gun sight secured to the picantinny rail of a gun or rifle wherein the leveling jack is in the second (upward) position and the gun sight is now currently level.

The pivot pin 40 may allow the leveling jack 1 to pivot so that the front 6 of the leveling jack 1 may rotate upward or downward between a first position (FIG. 1 to a second position as shown in FIG. 2). The front 6 of the leveling jack 1 may have an extended bar 80. Preferably, the extended bar 80 is cylindrical, so as to always contact the bottom 11 of the gun sight 10 in a flush manner. In particular, the extended bar 80 may be the portion of the leveling jack 1 that actually contacts and aligns the bottom 11 of the gun sight 10 so as to level the gun sight 10. In one embodiment, the extended bar 80 is cylindrical and may rotate around an internal pin so that the leveling jack 1 does not slightly alter the leveling of the sight 10 as the sight 10 is pushed upward into the level position while using the leveling jack 1.

In one embodiment, the leveling jack 1 may be secured to a picatinny rail 300 of the gun or rifle 100 (although it may also be secured directly to the gun or rifle in an embodiment). In an embodiment, a user may move the leveling jack 1 horizontally and may secure the leveling jack 1 to various locations on the picatinny rail 300. In particular, the leveling jack 1 may be selectively attached to different rails 375 of the picatinny rail 300 to better align the leveling jack 1 with respect to the bottom 11 of the gun sight 10. In alternative embodiments, the device 1 may be secured to a gun or file by use of, for example, straps, magnets, rings or securing strips as opposed to utilizing a picatinny rail 300 (which may not be present on the gun or rifle).

Figure 3:
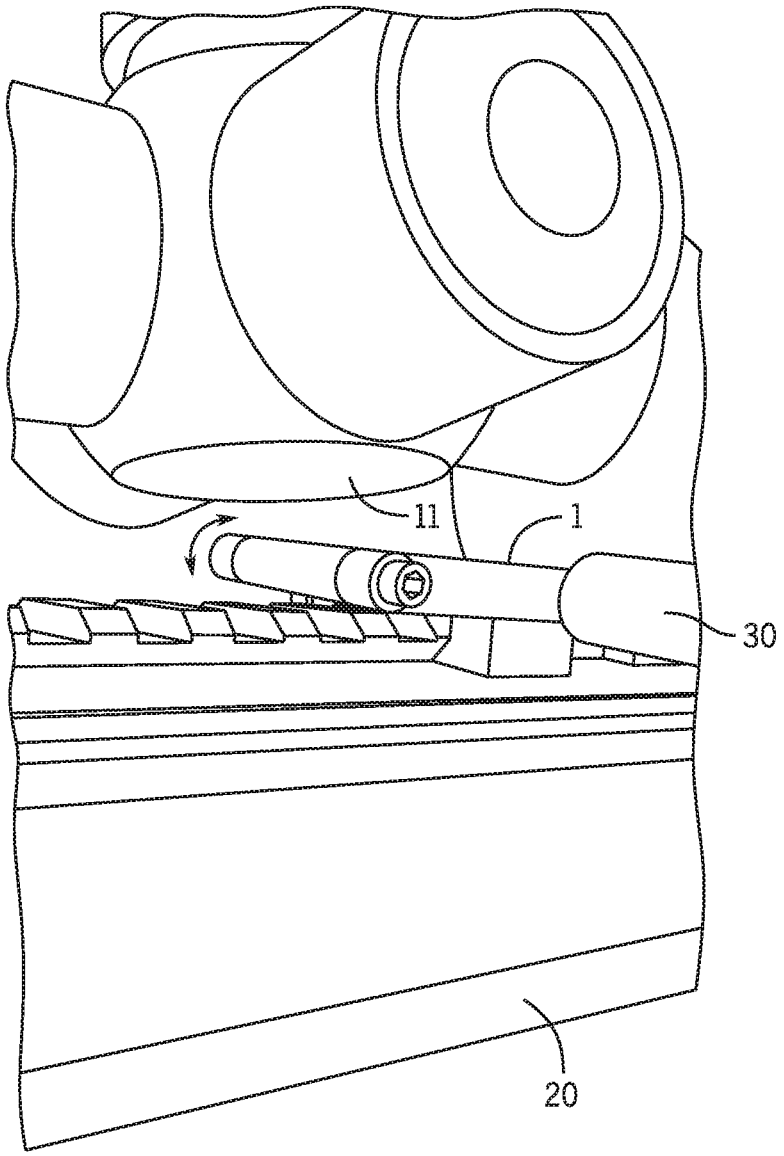
FIG. 3 illustrates another perspective view of the leveling jack for a gun sight secured to the picantinny rail of a gun or rifle wherein the leveling jack is in the first (lowered) position and the gun sight is not currently level

Typically, with prior art gun sights, when a gun sight 10 is secured to a gun or rifle 100, a user typically must try to adjust the gun sight by hand to make sure the gun sight is level with respect to the barrel of the gun or rifle. FIGS. 1 and 3 illustrate how the gun sight 10 is not level as attached in those figures. Leveling the gun sight 10 by hand is not always easy or accurate. Accordingly, the present leveling jack 1 allows a user to easily and quickly level the gun sight 10 with respect to the gun or rifle 100. In particular, when the gun sight 10 is not entirely level (like as shown in FIGS. 1 and 3) a user turns the extended knob 30 of the leveling jack 1 so that the front end 6 of the leveling jack 1 (with the extended bar 80) is raised upward and contacts the bottom 11 of the gun sight 10 and therein levels the gun sight 10 by pushing the extend bar 80 of the leveling jack 1 against the bottom 11 of the gun sight 10 in a flush manner.

In one embodiment, a spring (not shown) may be attached to the leveling jack 1. In the resting position, the leveling jack 1 may be in the generally relaxed position of FIG. 1. When a user hits a trigger, the spring is activated and forces the front end 6 of the leveling jack 1 upward so that the extended bar 80 contacts the bottom 11 of the gun sight 10 and levels the gun sight 10. Once the trigger is released, the front 6 of the leveling jack 1 may return to the downward position of FIG. 1.

The internal spring may be biased in the downward position. When a user moves the extended knob 30 upward to level the sight 10, the spring gets stretched. Once the user releases the upward pressure on the extended knob 30 the leveling jack 1 returns to the down (lowered) position of FIG. 1. In an embodiment, the leveling jack 1 may have at least one preset level which allows a user to move the leveling jack 1 to the desired preset level.

Finally, in one embodiment, the leveling jack 1 is at least partly magnetic so as to be able to be better secured to the gun or rifle 100. Further, in one embodiment, the extended bar 80 is magnetic and attracted to the bottom 11 of the sight 10 so that the force of the extended bar 80 is constantly attracted and constantly leveling the sight 10 when the leveling jack 1 is in the upward position.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

We claim:

1. A leveling jack for a gun sight comprising:

a base having a first end and a second end wherein the second end is secured to a barrel of a gun or rifle and wherein the first end of the base is unsecured and moves from a first positon to a second position with respect to the second end of the base and wherein the first end of the base of the contacts and is capable of leveling the gun sight in the second position;

wherein the gun sight is directly connected to the barrel of the gun or rifle and not connected to the base; and and wherein the base is located under the gun sight.

2. The leveling jack for a gun sight of claim 1 further comprising:

an extended knob at the second end of the base wherein the extended knob is capable of raising or lowering the first end of the base from the first position to the second position.

3. The leveling jack for a gun sight of claim 2 further comprising:

a pivot pin extending through the extended knob wherein the pivot pin is capable of rotating the base of the leveling jack with respect to the barrel of the gun or rifle.

4. The leveling jack for a gun sight of claim 2 wherein the extended knob is cylindrical and wherein the extended knob has a rough exterior surface.

5. The leveling jack for a gun sight of claim 1 further comprising:

an extended bar located at the first end of the base.

6. The leveling jack for a gun sight of claim 5 wherein the extended bar is cylindrical.

7. The leveling jack for a gun sight of claim 1 wherein the base is capable of being secured to a picatinny rail of the barrel of the gun or rifle.

8. The leveling jack for a gun sight of claim 1 wherein a portion of the base is magnetic and wherein the base is magnetically attracted to the gun or rifle.

9. The leveling jack for a gun sight of claim 1 wherein the base of the leveling jack has a top which is flat.

10. The leveling jack for a gun sight of claim 1 further comprising:

a spring connected to the base wherein the spring is biased to hold the first end of the base in the first position; and a trigger wherein the trigger forces the spring to move first end of the base to the second position and wherein in the second position the first end of the base contacts and moves the gun sight.

11. The leveling jack for a gun sight of claim 6 wherein the extended bar rotates.

* * * * *